United States Patent [19]

Leschonski et al.

[11] 4,321,134

[45] Mar. 23, 1982

[54] METHOD OF AND SORTING ASSEMBLY FOR DRY SORTING GRANULAR MIXTURES OF TWO OR MORE POLYDISPERSED COMPONENTS

[76] Inventors: Kurt Leschonski, Am Dammgraben 20; Stephan Röthele, Hüttenweg 9, both of D-3392 Clausthal-Zellefeld, Fed. Rep. of Germany

[21] Appl. No.: 78,948

[22] Filed: Sep. 26, 1979

[30] Foreign Application Priority Data

Sep. 29, 1978 [DE] Fed. Rep. of Germany ..... 2842295

[51] Int. Cl.[3] ..... B07B 9/00

[52] U.S. Cl. ..... 209/30; 209/133; 209/233

[58] Field of Search ..... 209/30–37, 209/133–137, 318, 315, 139, 233, 237, 312, 138, 143

[56] References Cited

U.S. PATENT DOCUMENTS

| | | | |
|---|---|---|---|
| 243,549 | 6/1881 | Granger | 209/37 |
| 298,900 | 5/1884 | Schutz | 209/30 |
| 532,266 | 1/1895 | Cuplin | 209/36 |
| 755,016 | 3/1904 | Koyl | 209/33 X |
| 968,984 | 8/1910 | Ringland | 209/33 X |
| 1,941,212 | 12/1933 | Johnson | 209/35 X |
| 2,144,418 | 1/1939 | Schramm | 209/37 X |
| 2,853,191 | 9/1958 | Mogensen | 209/315 |
| 3,044,619 | 7/1962 | Krolle | 209/33 |
| 3,097,075 | 7/1963 | Vandenhoeck | 209/30 X |
| 3,263,808 | 8/1966 | Schwartz | 209/30 |
| 3,929,628 | 12/1975 | Denevi | 209/36 |
| 3,986,979 | 10/1976 | DiDuca | 209/35 |
| 4,133,749 | 1/1979 | Selinek | 209/32 |

FOREIGN PATENT DOCUMENTS

| | | | |
|---|---|---|---|
| 2108983 | 8/1972 | Fed. Rep. of Germany | 209/34 |
| 2657754 | 6/1978 | Fed. Rep. of Germany | 209/135 |

*Primary Examiner*—Robert Halper

*Attorney, Agent, or Firm*—Kenyon & Kenyon

[57] ABSTRACT

In a method of and assembly for sorting a granular two- or multi-component mixture, containing a number p of granular, polydisperse solid components to be sorted out the particles of which differ in density and/or shape and have at least partially overlapping particle size and settling rate (particulate characteristics) distributions the mixture, in which the components are present sortable, is subjected to two dry classification steps in which different particulate characteristics of the particles are decisive. First, the feed mexure is dry classified in a first step, in particular by sieving or wind sifting, into a greater number of classes of a first particulate characteristic, (into screening classes or settling rate classes), which are sufficiently narrow with a view to the subsequent separation of the components to be sorted out and in which the fractions of the second particulate characteristic (the settling rate fractions or screening fractions) of the individual components are contained separately or consecutively or only slightly overlapping. Then the components are separated in a second step by subjecting each class obtained to further classifying, in series of successive classifications, in particular wind siftings or sievings, so as to obtain the sorted out components pure or enriched. The selection of the width of the classes in the first step must be made, in consideration of the desired and possible sorting by classifying in the second step, in which the second particulate characteristic of the particles is decisive, such that graduation of the cut-off limits of the classifying in the second step is made possible in a manner at which the two limits of the second particulate characteristic determine the particles to be recovered of each fraction which does contain particles of the components to be sorted out. Thus the largest particles of the respective lighter component, to be sorted out, can be separated from the smallest particles of the respective heavier component to be sorted out.

15 Claims, 6 Drawing Figures

Figure 1:
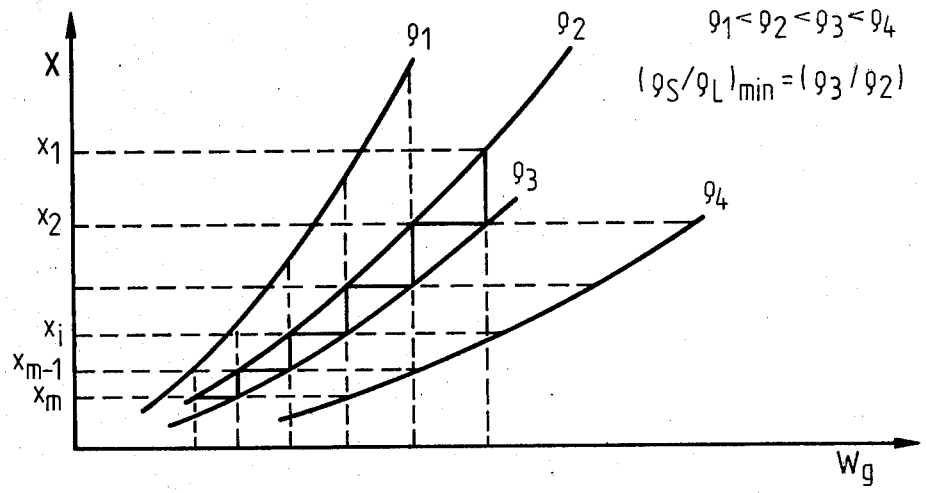

F
$x_1$
$x_i$
$x_{m-1}$
$x_m$
5'
5''
5
6
7
9
1
2
3
4
8
11
12
$v_{L1}$
$v_{Lc}$
$v_{Lc+1}$
$v_{Lm}$
$v_{Lm+1}$
Z
P 2
P 1

METHOD OF AND SORTING ASSEMBLY FOR DRY SORTING GRANULAR MIXTURES OF TWO OR MORE POLYDISPERSED COMPONENTS

The instant invention relates to a method and assembly for dry sorting a granular mixture, containing a number p of granular, polydisperse solid components to be sorted out the particles of which differ in density and/or shape and have grain size and settling rate distributions which are so wide that they overlap at least in part. In sorting the mixture into its components or sorting out certain components, the respective components are to be recovered pure or at least sufficiently enriched.

The methods applied so far for sorting out the components of higher value, suitable for further processing, from a two- or multi-component mixture may be divided into wet and dry processes.

With many mixtures wet processes cannot be applied if the components of the mixture are not to be contacted with liquid. Where wet processes are applicable, pure water, as a rule, cannot be employed for the separation. This renders the respective methods expensive and even dangerous if highly poisonous solutions or suspensions must be used. For reasons of ecology these methods also are undesired because the unavoidable preparation of the liquids needed for separation always entails waste water problems. As regards the processing of the pure or enriched components, these methods often have the disadvantage that the separated components must be dried at great energy consumption.

For these reasons there is great demand for dry sorting methods for particulate mixtures. The known dry sorting methods, in general, do not permit satisfactory throughputs at sharp separation limits and high yields of the components to be sorted out. The same applies to manual or mechanical picking methods. The conventional classification by grinding and sieving or screening by means of gyratory vibrating sifters and so-called grit purifying installations separating light-weight impurities, as used in flour mills, provides satisfactory sorting only since the components are largely monodisperse in the feed mixture, and their particle size distributions do not overlap or practically not, rather than that they should be polydispersed and have particle size distributions which overlap considerably or entirely. If the density and/or shape happens to be quite different, conventional methods can also be successful.

It is the object of the invention to provide for dry sorting of a granular mixture, containing a number p of solid components to be sorted out, the particles of which differ as to density and/or shape and have grain size and settling rate (particulate characteristics) distributions which overlap in such manner that the components of the mixture are recovered pure or strongly enriched, i.e. with only minor proportions of the respective other components.

It is another object of the invention to devise the sorting such that the yields of the components sorted out are high. It is also an object of the invention to recover the components such that they can be supplied as secondary raw materials to corresponding processes of renewed or further utilization or reuse. It is likewise an object of the invention to provide an inexpensive sorting assembly which can be operated economically.

To meet these and other objects which will become apparent from the specification, it is provided, in accordance with the invention, that in a sorting process, in which the feed mixture introduced into the process is subjected to classifications so as to recover the p components to be sorted out, in a first step, the feed mixture is dry classified into successive classes of such limited extent of a first particulate characteristic of the particles that said classes contain the fraction of the second particulate characteristic, decisive for a subsequent further classification, of the particles of each component, to be sorted out, separately from the fractions of the other components or only slightly overlapping those fractions, and, in a second step, each component to be sorted out of each class of the first particulate characteristic is sorted out by a series of successive further dry classifications for which the second particulate characteristic of the particles is decisive, at cut-off limits or cut sizes which correspond to the two limits of the second particulate characteristic of the particles of each fraction which does contain particles of the components to be sorted out.

This method is realized particularly conveniently in two embodiments, of which the first will be preferred for various reasons.

In the case of the first embodiment of the method according to the invention it is provided that in the first step, the feed mixture is classified, by sieving, into successive screening classes in which the settling rate fraction of each component to be sorted out is contained separately from or only slightly overlapping the settling rate fractions of the other components, and, in the second step, each component to be sorted out of each such screening class is sorted out by a series of successive wind siftings of each class into fractions, at sifting air velocities at which, on the one hand, the highest and, on the other hand, the lowest settling rate particles of the fraction which are to be recovered, of the respective component, to be sorted out, are separated at least substantially.

With this embodiment of the invention, in the first step, the starting mixture thus is classified by screening or sieving into sieve grain size classes, or simply screening classes, while in the second step, the components to be sorted out are separated successively by air classification or wind sifting of the screening classes obtained.

The second embodiment of the invention, on the other hand, is embodied by a method wherein, in the first step, the feed mixture is classified, by wind sifting, into successive settling rate classes in which the screening fraction of each component to be sorted out is contained separately from or only slightly overlapping the screening fractions of the other components, and, in the second step, each component to be sorted out of each such settling rate class is sorted out, after separation of the same from the sifting air, by a series of successive sievings of each class into fractions, at mesh sizes at which, on the one hand, the coarsest and, on the other hand, the finest particles of the fraction which are to be recovered of the respective component to be sorted out are separated at least substantially It is understood that the terms used throughout the specification and claims should have the following meanings:

Sorting is the separation of a granular mixture of at least two components of different substance into the pure or strongly enriched components, i.e. components containing the least possible proportion of the respective other components. As an example, we may mention the separation of a mixture of copper and aluminum particles into a copper fraction and an aluminum fraction.

Classifying is the separation of a granular mixture into two classes of dispersion characteristics of its particles.

Particles have different particulate characteristics.

As a geometrical particle or grain characteristic, a particulate characteristic of a particle is its sieve grain size or screening size, in other words the size corresponding to the mesh size $x_i$ through which the particle will just pass during the screening process.

Another particulate characteristic of a particle is its settling rate in a certain flow medium, such as air, water or oil. In the present case the settling rates refer to air because, as a rule, all wind siftings or air classifications are carried out in air. Apart from the screening size, the settling rate also depends on the density and shape of the particles. The settling rate is not directly proportional to the screening size.

Other particulate characteristics are the configuration (shape) and specific surface of the particles.

By class we refer to a range of a first particulate characteristic between two limits.

By fraction we refer to a range of a second particulate characteristic between two limits.

Settling rate classes or fractions are classes of particles containing particles of different settling rates between an upper and a lower limit. Settling rate classes or settling rate fractions are obtained by successive classifications, in particular by means of wind sifting or air classification methods (flow separating processes) at different settling rates.

Sieve grain size classes or fractions or screening classes are classes of particles containing particles of different screening size between an upper and a lower limit. Screening classes or screening fractions are obtained by successive sievings or screenings at different mesh sizes.

The cut-off or separation limit or cut size of a classifying method, in particular screening or wind on air sifting, refers to the particle size (limit particle size) 50% of which are present in the coarser (in the case of sieving) or heavier (in the case of wind sifting) class or fraction and 50% in the smaller (in the case of sieving) or lighter (in the case of wind sifting) class or fraction, after the classifying. The cut size of a screen is its mesh size, provided the screening takes sufficiently long. The cut-off limit of a wind sifter is determined by the sifting air velocity which is the air velocity which divides the particles of the cut size into 50% going with the coarse material and 50% with the fine material.

Thus, the invention provides, first, to classify the feed mixture in a first step, in particular by sieving or wind sifting, into a greater number of classes of a first particulate characteristic (screening classes or settling rate classes), which are sufficiently narrow with a view to the subsequent separation of the components to be sorted out and in which the fractions of the second particulate characteristic (settling rate fractions or screening fractions) of the individual components are contained separately or consecutively or only slightly overlapping. The invention, then, provides to separate the components in a second step by subjecting each class obtained to further classifying, in series of, normally at least (p−1), successive classifications, in particular wind siftings or sievings, so as to obtain the sorted out components pure or enriched. The selection of the width of the classes in the first step must be made, in consideration of the desired and possible sorting by classifying in the second step, in which the second particulate characteristic of the particles is decisive, such that graduation of the cut-off limits of the classifying in the second step is made possible in a manner at which the two limits of the second particulate characteristic determine the particles to be recovered of each fraction which contains particles of the components to be sorted out.

Thus the largest particles of the respective lighter component, to be sorted out, can be separated from the smallest particles of the respective heavier component to be sorted out. In this manner the classes resulting from the first step, namely the screening classes or settling rate classes, respectively, can be divided into their components or each component to be sorted out can be separated in the second step.

Figure 3:
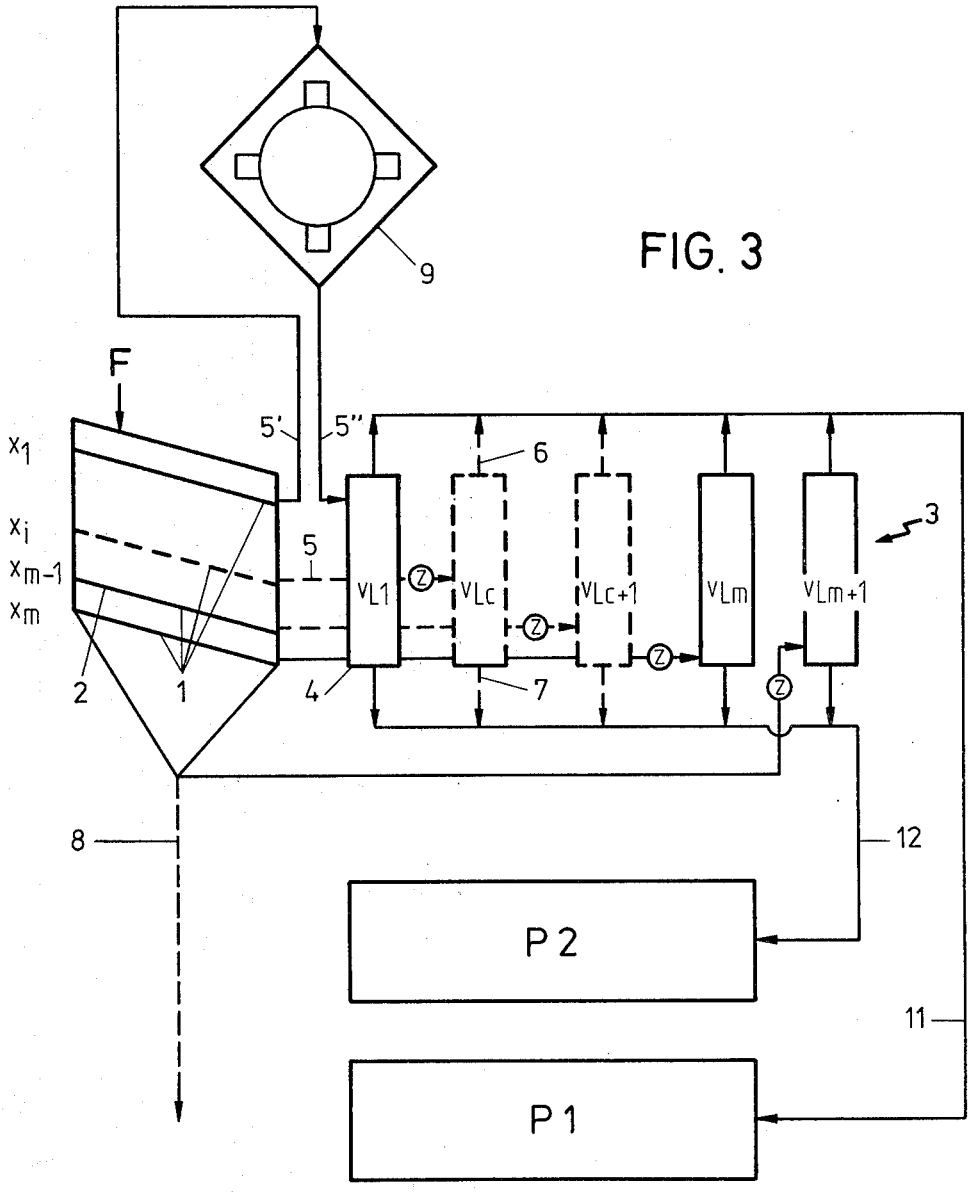
Figure 4:
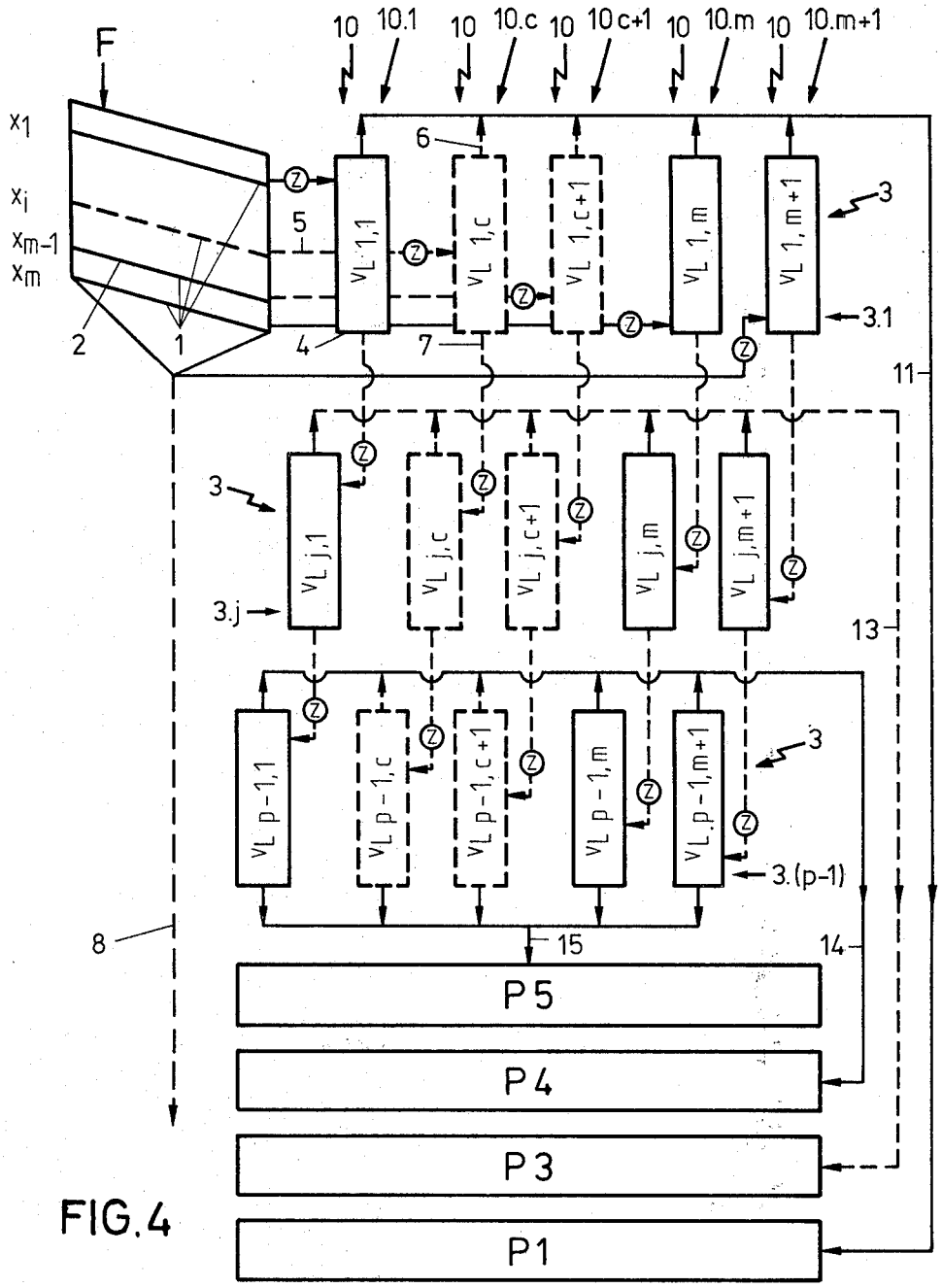

If it is desired to sort out all components of a feed mixture, this can be achieved by a method wherein, in the first step, the feed mixture is classified, by m sievings, into (m+1) successive screening classes, the mesh sizes $x_i$ for the successive sieves being so selected that the settling rate fractions of the individual components in each screening class are separated from each other or overlap only slightly, and, in the second step, each of the (m+1), at least ((m/2)+1), screening classes is sorted by means of a series of (p−1) successive wind siftings into p settling rate fractions of one component each, and the respective light fractions of each wind sifting and the respective heavy fraction of each last wind sifting are withdrawn individually or combined as desired (FIGS. 3 and 4).

Particularly pure components are obtained by the invention if the mesh size $x_i$ is determined by the smaller mesh size $x_{i+1}$ of the adjacent sieve according to the equation $$x_i \leqq x_{i+1} \sqrt[n]{(\rho_S/\rho_L)_{min}}$$

in which n is a parameter between 2 and 1, allowing for the inclination of the curve of the drag coefficient of the sifting air flow around the particles at the sifting air velocity, and having value 2 in the range of laminar flow and value 1 in the range of turbulent flow, and a value which decreases from 2 to 1 approximately proportionally to the logarithm of the Reynolds number in the transitional range of flow, and $(\rho_S/\rho_L)_{min}$ is the smallest ratio of the density $\rho_S$ of a heavier component and the density $\rho_L$ of a lighter component.

Figure 5:
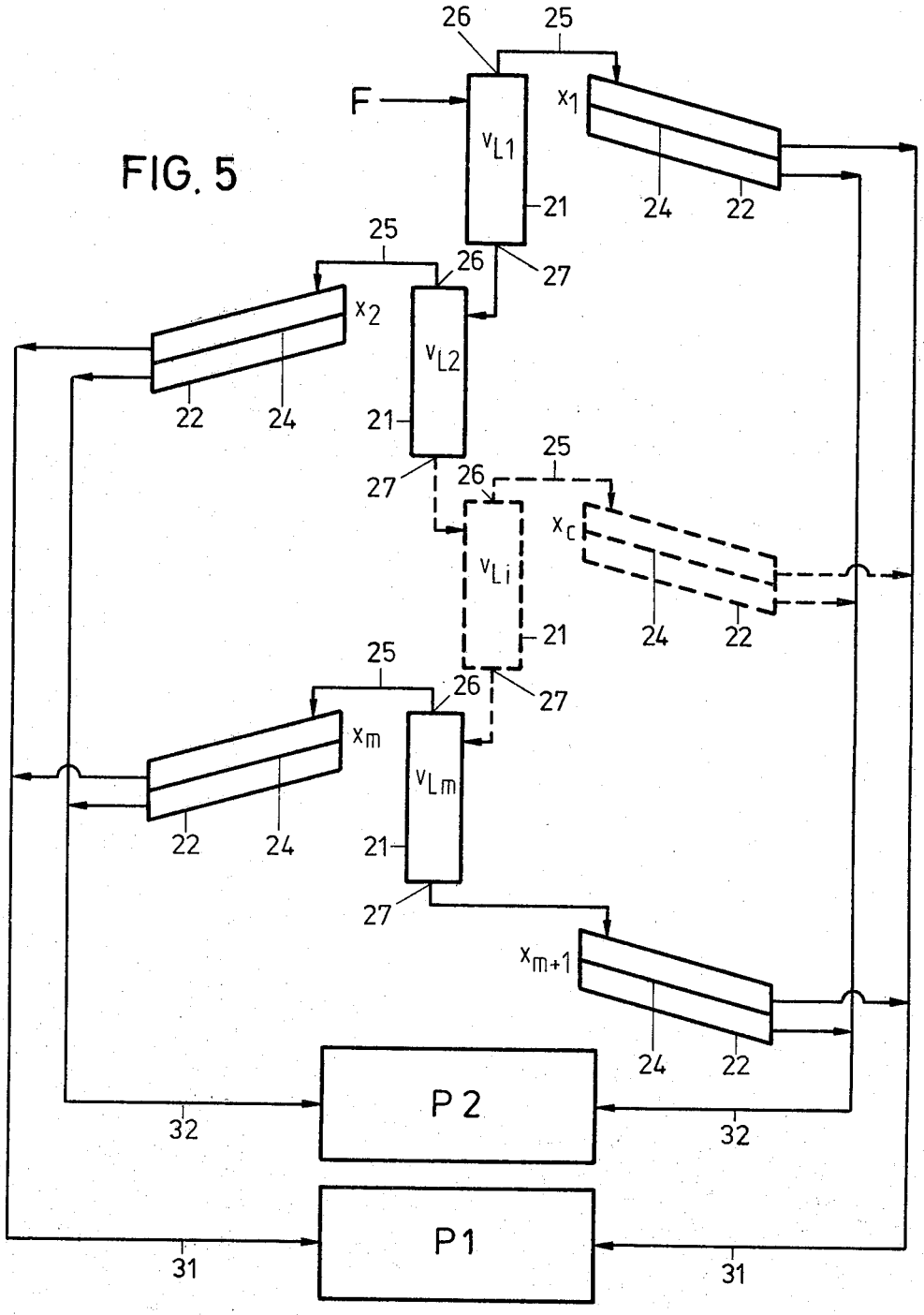
Figure 6:
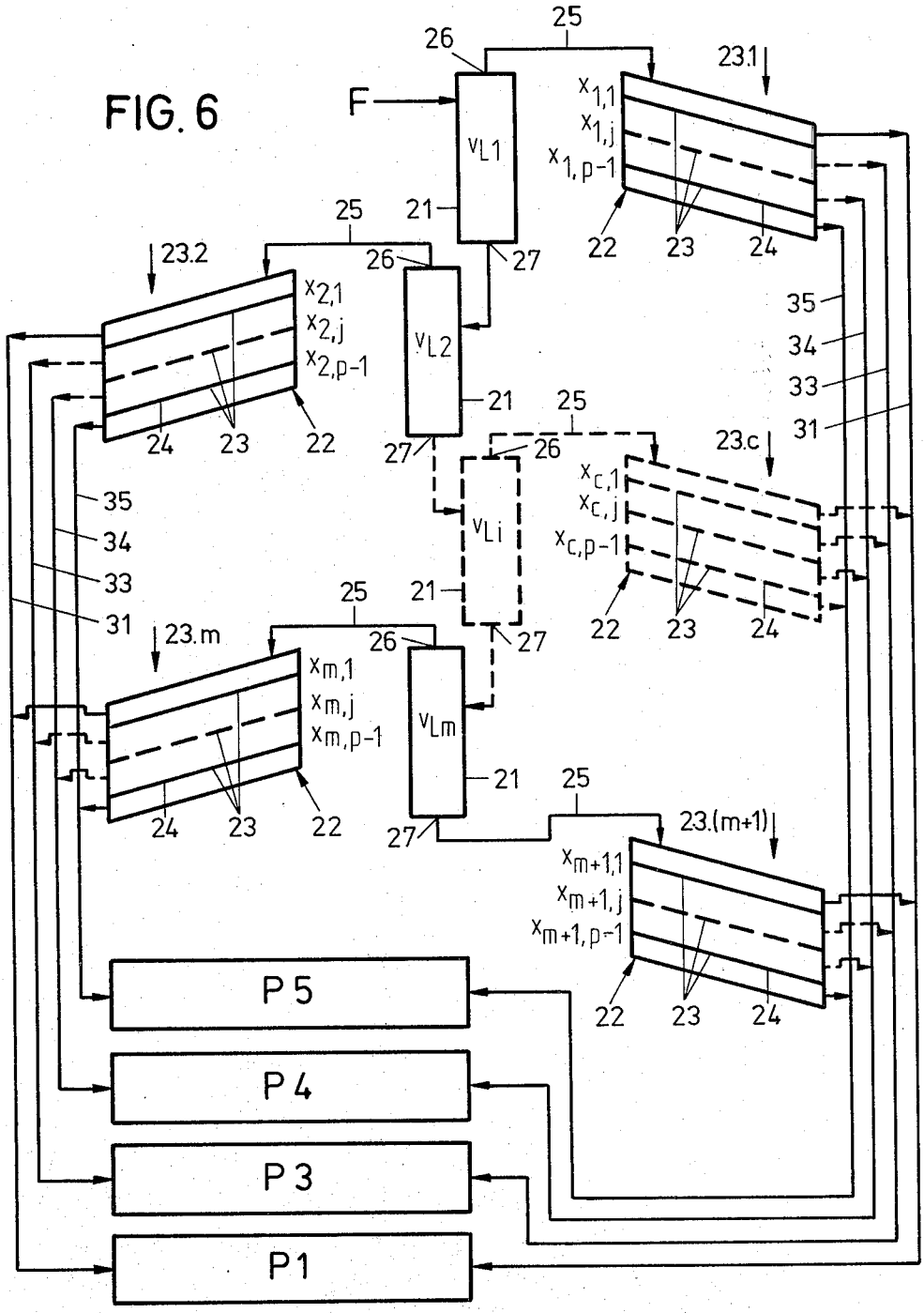

As an alternative to this method it is also possible to apply wind sifting in the first step. In that case the separation into all components is effected by a method wherein, in the first step, the feed mixture is classified, by successive wind siftings, into (m+1) successive settling rate classes, the respective heavier settling rate class of the first (m−1) wind siftings being supplied as feed material to the respective next wind sifting, and the sifting air velocities $v_{Li}$ of the successive wind siftings being so selected that the screening fractions of the individual components in each settling rate class are separated from each other or overlap only slightly, and, in the second step, each of the (m+1), at least ((m/2)+1), settling rate classes is sorted by means of a series of (p−1) successive sievings into p screening fractions of one component each, and the fractions of the respective same component are withdrawn individually or combined as desired (FIGS. 5 and 6).

With this embodiment particularly pure components are achieved if the sifting air velocities $v_{Li+1}$ are determined by the lower sifting air velocity $v_{Li}$ of the respective preceding of following sifting according to the equation $$v_{Li+1} \leqq v_{Li} \cdot \sqrt[n]{(\rho_S/\rho_L)_{min}} \quad ; 1 \leqq n \leqq 2$$

having value 1 in the range of laminar flow and value 2 in the range of turbulent flow, and a value which increases from 1 to 2 approximately proportionally to the logarithm of the Reynolds number in the transitional range of flow.

Useful components for sorting in accordance with the invention are any kinds of substances used as feed mixtures in conventional separating or dressing plants, such as mineral raw materials, like mixtures of coal, pyrite, mine fillings or waste, metallic raw materials, like ore and tailings or ore mixtures and tailings, and, beyond the classical separation, any residual matter and special waste material as feed mixtures for sorting out any of the following:

e.g. aluminum and other non-ferrous metal shares out of shredder scrap, upon separation of magnetic iron parts, or rubber, fabric, steel particles, and impurities out of shredded old tires, or wires, rubber, plastics of the sheathing, and impurities out of cable rests, or special products and plastics out of residues of composite plastic materials, or sand out of blasting materials used in foundries.

Sorting in accordance with the invention is successful with all those feed mixtures of differently dispersed solids in which the differences in density and/or shape and thus in settling rate of the components, which is dependent on their particle size, are sufficiently distinct.

A suitable feed mixture in which the components to be sorted out are contained separately and in a screening range suitable for sieving and wind sifting is required for the realization of the method according to the invention. In many cases, therefore, the starting product which is as yet unsuitable must be subjected to comminution, often combined with classification, so as to establish a suitable particle size range prior to feeding the material into the classifying step. If the starting material is a composite material, the "intergrowth" of the components must be removed to the greatest extent possible as in the conventional separation of mineral raw materials. The subsequent sorting will be the more perfect, the better a composite material for instance was disintegrated into particles of one kind or the other by preceding comminution. When sorting a two- or multicomponent mixture, the feed mixture for the downstream classifying step (wind sifting or sieving) consists of a mixture of two or more dispersed solids which differ as to screening or settling rate distribution. As regards different densities and/or shapes, we may differentiate between three cases: In the first case the components differ only as to solids density, whereas the shape is the same. This permits sorting into the components. In the second case the density of the components is the same but their shape differs. This means that the method is applicable also to sorting a mixture of substances of the same density and different shapes into the different shapes. In the third case, which is the rule, the particles differ both in density and shape. Differences in the shape of the particles of the components may have positive or negative influences on the method. Thus, it is quite possible that particles of the same size, although differing in density and shape, still have the same settling rate. This means that the novel method is not applicable. As indicated above, the classification in the first step must yield classes which are so narrow that the components to be sorted out actually can be separated from each class in the second step by a further classification.

If classifying in the first step was effected by sieving, the feed in the second step consists of screening classes. Sorting any such screening class into two components, such as by gravity—countercurrent classification, cannot be effected unless, for example, the limits of the classes in sieving which are determined by the mesh sizes $x_i$ and $x_{i+1}$ of successive sieves ($1 \leqq i \leqq m$) were so selected that the settling rate of the specifically heavier particles corresponding to the respective larger mesh sizes $x_i$ which defines the upper limit of the class is faster than or at least equal to the settling rate of the specifically lighter particles corresponding to the respective smaller mesh size $x_{i+1}$ which defines the lower limit of the class. If the feed is a multicomponent mixture, the class limits must be so close that the settling rate ranges of the various components do not overlap at all or only slightly. This condition is fulfilled if the condition stipulated for a two-component mixture is met with respect to those two adjacent components of the multicomponent mixture which have the smallest settling rate ratio for particles of the same size, in other words whose settling rate distributions are closest together, thus placing the most critical demand on the first step in order that sorting in the second step may be achieved.

FIG. 1 demonstrates the dependence of the screening size x of the particle distributions of four components of different densities $\rho_1$, $\rho_2$, $\rho_3$, $\rho_4$ ($\rho_1<\rho_2<\rho_3<\rho_4$) and certain shape each, on the settling rate $w_g$. The density ratio of components 3 and 2 is the smallest. The line of steps drawn between these two components determines the width of the screening classes and of the settling rate classes must be obtained by classifying in the first step in order that the fractions of the respective other dispersion characteristic of the components will adjoin at best, usually be slightly apart or overlap somewhat. It may be seen in the figure that the particle size distributions of the four components overlap to a large extent, i.e. all components are represented in the range from $x_i$ to $x_m$.

Based on the above, the selection of all class limits for sieving and thus of the mesh sizes $x_i$ and $x_{i+1}$ of adjacent sieves permitting subsequent wind sifting for purposes of sorting, may be estimated, for instance, for a gravity countercurrent wind sifter because there is equality between the sifting air velocity $v_L$ and the settling rate $w_{gt}$ of the separation limit size $$v_L = w_{gt} \quad (1).$$

Figure 2:
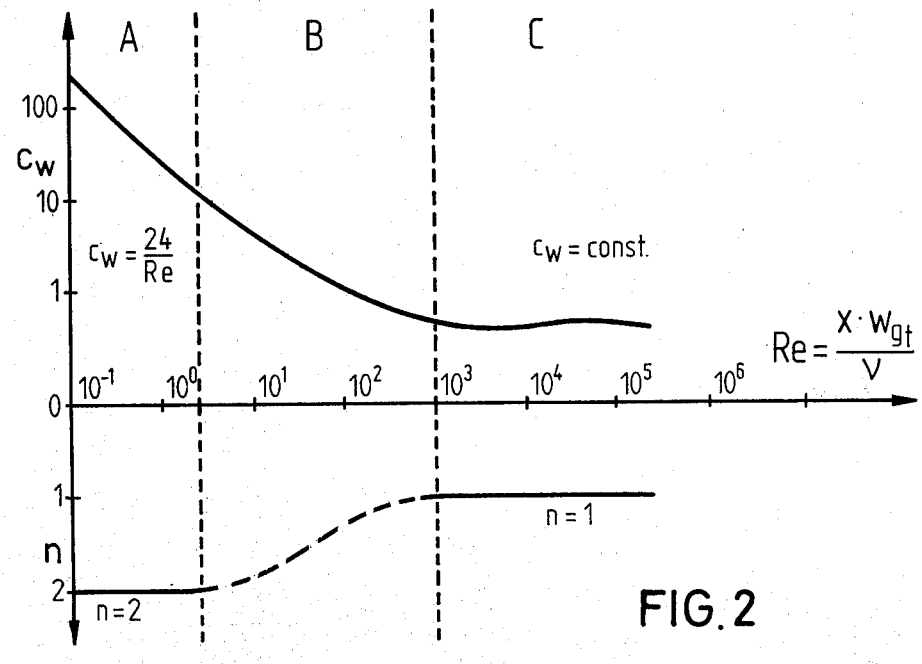

The values of $w_{gt}$ and thus of $v_L$ are determined by the law governing the resisting forces of flow around particles in a wind sifter or air classifier. In general, a difference must be made between the kinds of flow around the particles, namely laminar flow (n=2) (cf. range A, $Re \leqq 2.5$, in FIG. 2) governed by Stoke's Law, turbulent flow (n=1) (cf. range C, $Re \geqq 1000$, FIG. 2) in which the drag is proportional to the square of the velocity, and the flow in the transitional range between the two, namely flow ($1 \leqq n \leqq 2$) (cf. range B in FIG. 2). "n" is a parameter allowing for the inclination of the curve of the drag coefficient of the sifting air flow around the particles at the sifting air velocity. FIG. 2 illustrates the drag coefficient curve which demonstrates the dependence of the drag coefficient $c_w$ on the Reynolds number $Re = x.v_L/\nu$ ($\nu$ being the kinematic viscosity) and the curve of parameter n in dependence on the Reynolds number.

If it is assumed that the particles are spherical, disregarding the influence of the shape, the general teaching for the selection of the class limits or graduation of the sieves in accordance with the condition explained above may be presented as follows $$x_i \leqq x_{i+1} \cdot \sqrt[n]{(\rho_S/\rho_L)_{min}} \; ; 2 \geqq n \geqq 1, \tag{2}$$

Thus the graduation of the mesh size $x_i$ with respect to the next smaller mesh size $x_{i+1}$ in simplified manner is largely calculated by the nth root of the smallest density ratio of the particles of a heavier component having density $\rho_S$ with respect to the particles of a lighter component having density $\rho_L$ of the feed mixture. In two-component feed mixtures the density ratio of the two components thus is decisive. In the case of multicomponent feed mixtures the smallest density ratio is established between those components which have their settling rate distributions, dependent on the grain size, closest together. n has value 2 for laminar flow and value 1 for turbulent flow.

Experimental investigations have shown that it may be assumed that wind sifting of coarse particles generally is carried out in turbulent flow so that for approximately spherical particles, n will be close to 1. On the other hand, if the particles are far from being spherical in shape and sifting is effected in the transitional range between laminar and turbulent flow, n will be near 1.5. When sifting fine particles, the influence of the shape becomes less important. It is usually carried out in the laminar range so that n will be closer to 2. The flow range which is decisive for the optimum realization of the method depends on the variety of shapes and densities of the components of interest in the feed mixture. Thus it may be necessary, first, to give the starting product the most favorable particle size range by additional comminution and classification.

The condition (2) for the graduation of the mesh sizes need be fulfilled only "substantially". This is to express that the cuts in separating need not necessarily be made at those mesh sizes which result from the calculation. Instead, commercially available sieves having standardized mesh sizes may be drawn upon, rather than having to produce special sieves with mesh sizes as determined by the calculation. The number of mesh sizes available in the standardized screen series is great enough for realization of the method in "substantial" agreement with the conditions defined in the claims. Of course special cases are conceivable which justify the manufacture of sieves with special mesh sizes differing from standard so as to obtain distincter cut-off limits and consequently better enrichments and higher yields.

In analogy, the condition to be fulfilled for the necessary graduation of the sifting air velocities, if wind sifting is applied in the first step, to permit sieving for purposes of sorting in the second step, may be presented as follows $$v_{Li+1} \leqq v_{Li} \cdot \sqrt[n]{(\rho_S/\rho_L)_{min}} \; ; 1 \leqq n \leqq 2, \tag{3}$$

Thus, again in simplified manner, the graduation of the respective higher sifting air velocity $v_{Li+1}$ with respect to the respective lower sifting air velocity $v_{Li}$ is largely calculated by the nth root of the smallest density ratio of the particles of a heavier component with respect to the particles of a lighter component of the feed mixture. In this case n has value 1 for laminar flow and value 2 for turbulent flow.

For technical realization, the parameter n which takes into consideration the kind of flow of the sifting air around the particles must be so selected that allowance is made for the incident flow condition prevailing in the wind sifter as well as the possibly competing influence of the shape of the particles to be separated. This is to be determined experimentally by tests preceding any application of the method.

If the classification in the first step is made by sieving, the screening classes obtained are separated into the components by series of wind siftings in sets of wind sifters. In the wind sifters of the respective set and of the respective stage of wind sifting the sifting air velocity $v_{Lj,c}$ (index j designating the component or sifting stage and index c the set of wind sifters) is so adjusted that the following applies $$v_{Lj,c} = k w_{gt} \tag{4}$$

in which $w_{gt}$ is the settling rate in air of the coarsest particles of the lighter component to be separated of the respective screening class and k is a constant between 0.3 and 1 allowing for the shape of the particles, the loading of the sifting air with particles, and the type of sifter employed.

The settling rate $w_g$ of a particle in air is to be calculated according to the known laws.

Tests have confirmed the workability of the invention and have shown that, for separating the most common density ranges, the calculation of the graduation of the mesh sizes and sifting air velocities, respectively, may be based on the smallest density ratio of the components to be separated. The applicable sifting air velocity $v_{Li}$ in a case of using, for example, zig-zag sifters in the sorting stage is calculated on the basis of equation (4), wherein $k = 0.5$, according to the influence of the different particle shapes in the components to be separated.

The necessary adjustment of the sifting air velocities in the wind sifter, e.g. a wind sifter with rising air flow may make deviations from the above definition necessary. This must be determined by preceding testing.

In any case, however, in the preferred gravity—wind sifting, the sifting air velocity must correspond to the settling rate of the coarsest light particles to be sorted out of the screening class or must be adjusted to be a little lower than the settling rate of the smallest of the next heavier particles contained in the screening class.

As descriptions of shape of particles are hardly possible quantitatively, accurate quantative statements for the selection of the graduation can hardly be made if the components involved differ very much in shape. Yet great differences in shape improve the method according to the invention in that wider classes are admissible in the classifying by sieves, which means that the steps in sieving can be greater if the influence of the shape is greater on the settling rate distribution of the specifically heavier particles than on the settling rate distribution of the specifically lighter particles. In that event the number of sieves for classifying may be smaller. This makes the method more economical.

If wind sifting was applied in the first step classification, the settling rate classes obtained are separated into the components by series of sievings with the aid of sets of sieves. The mesh size $x_{cj}$ (index c designating the settling rate class or set of sieves and index j the component) of the sieves of the respective sets of sieves determining the separation of the components always is so defined that it is somewhat smaller than the smallest particles to be sorted out of the respective lightest component contained in the settling rate class.

The method of the invention may be applied for particle sizes beginning with approximately 30 μm, provided the technically available air jet sifting can still be used efficiently in this range of particle size. The upper limit for application of the invention is a particle size of about 30 mm at $\rho_L=5$ g/cm$^3$. This depends, on the one hand, on the screening machines available. In the case of the Mogensen principle, for instance, the machines can be used up to this limit. On the other hand, this depends on the technical expenditure in the classifying or sorting by means of wind siftings. All the technically useful screening methods and sieves, such as plane sieves, vibratory and circular oscillating sieves, in single or in multiple arrangement are applicable in the particle size range mentioned.

Conveniently the wind sifters are designed for rising air flow (air elutriatiors), e.g. as so-called zig-zag sifters from which the light particles are discharged pneumatically at the top end and the heavy particles fall out at the bottom. Such a classifier is a counter flow or countercurrent gravity-balance wind sifter (air classifiers).

As an alternative to this gravity—countercurrent sifting in wind sifters with rising air flow it is possible to use crosscurrent wind sifting, such as applied with the unclassified feed mixture, as mentioned above. In this event at least some of the wind siftings should be effected as crosscurrent siftings with the air flowing transversely through the stream of particles falling down as a thin layer. With this kind of wind sifting with cross flow, the energy consumed to generate the sifting air stream is less than in the case of countercurrent wind sifting where the stream of air not only has to separate the light particles from the heavy ones but also must convey the light particles pneumatically to a separator. With the cross flow wind sifters, on the other hand, the particles are moved away by mechanical conveyor installations downstream of the sifting zone.

Centrifugal wind sifters, e.g. spiral flow air classifiers or deflection air classifiers may be employed for the range of smallest particles defined above.

Large quantities of air are needed to separate very large and therefore heavy particles by way of wind sifting because of the high settling rate. For this reason it is provided, in accordance with an embodiment of the invention, with which the feed mixture is first classified by sieving, that the portion rejected by the coarsest sieve which has a mesh size $x_1$ is crushed and again introduced into the feed mixture or directly sent to a dump or processed further in another manner. From the point of view of energy consumption comminution of the large particles may be more favorable than sorting by screening and sifting. On the whole, the preceding comminution stage not only provides the disintegration described of the starting material but also serves to render the spectrum of particle sizes more uniform so that the number m of sievings or siftings required in the classifying stage and to be determined as described, and the number of downstream sifters or sieves required can be kept as low as possible. Furthermore, it may be advantageous (see claim 8) to effect selective comminution of the screening classes, with a view to comminuting the lighter components, after classification by sieving and before some or all of the siftings. In this manner the downstream sorting by sifting may be facilitated because of the different comminution behavior of the components, or it may be made more effective or realized with a smaller number of wind sifters.

The discrimination and expenditure of the dry sorting in accordance with the invention rise as the number of narrower screening classes or settling rate classes in the classification stage rises. In the same way, the enrichment increases, i.e. the quality improves and possibly also the yield of essentially pure components. As the economy of the method depends not only on the technical expenditure and on the time and personnel invested but also on the price which the market will offer for the sorted final product, the most economical method will be located between the extremes outlined above and has to be decided for each feed mixture to be separated by previous testing.

Customary particle distribution ranges in various mixtures of materials, for example in the field of minerals, special residual material, or composite substances, non-ferrous metal portions in shredder scrap, coal and tailings, garbage, and other raw materials, even ores will require from m=5 to m=15 sets of sieves or wind sifters. In the case of multicomponent mixtures up to p=5 components are conceivable for sorting in accordance with the invention.

As an example of how the method of the invention is applied in practice, reference is made to the sorting of aluminum particles ($\rho_2=2.7$ g/cm$^3$) out of contaminating non-metals ($\rho_1=1.85$ g/cm$^3$) and heavy metals ($\rho_3=4.2$ kg/dm$^3$) as contained in shredder scrap. The fines of the sieve of mesh size $x_{10}$ are discarded before the second step. The parameters used in a corresponding sorting assembly (see FIG. 4) are as listed in the table below in which:

1. = mesh screening class
2. = mesh size $x_i$ (first step)
3. = sifting air velocity $v_{L1c}$ (second step, first sifting stage)
4. = sifting air velocity $v_{L2c}$ (second step, second sifting stage)
5. = mesh size of standard screen series R 40 of DIN 4188 (ISO recommendation 150 R 3 DIN 323 NFX 01-0.01 B.5.2.045) yet values of sifting air velocities unchanged

| | | | | | | | | | | | |
|---|---|---|---|---|---|---|---|---|---|---|---|
| 1. | 1 | 2 | 3 | 4 | 5 | 6 | 7 | 8 | 9 | 10 | — |
| 2. | 27.5 | 22.5 | 18.8 | 15.5 | 12.9 | 10.7 | 8.8 | 7.3 | 6.0 | 5.0 | mm |

-continued

| | | | | | | | | | | | |
|---|---|---|---|---|---|---|---|---|---|---|---|
| 3. | 21.1 | 19.2 | 17.4 | 15.9 | 14.4 | 13.1 | 11.9 | 10.9 | 9.9 | 9.0 | m/s |
| 4. | 28.5 | 25.9 | 23.6 | 21.5 | 19.6 | 17.8 | 16.2 | 14.7 | 13.4 | 12.0 | m/s |
| 5. | 28.0 | 22.4 | 19.0 | 16.0 | 13.2 | 11.2 | 9.0 | 7.5 | 6.3 | 5.6 | mm |

A sorting assembly which is suitable for carrying out the method and by means of which p components (of a plurality of components) can be sorted out of a feed mixture comprises a first step with a set of $m \geqq 3$ successive dry classifiers for classifying the feed mixture into classes of a first particulate characteristic of the particles of the feed mixture, which classes contain the fraction of the second particulate characteristic of the particles of each component, to be sorted out, separately from or only slightly overlapping the fractions of the other components, and a second step with sets of successive further dry classifiers each, for each class, to separate the classes into successive fractions, at cut-off limits which correspond to the two limits of the second particulate characteristic of the particles of each fraction of the components to be sorted out, one class each being adapted to be fed to the respective first classifier of a set of the further classifiers, and the respective pure or strongly enriched fractions of the components being adapted to be withdrawn individually or combined as desired from the further classifiers.

A preferred embodiment, with which the feed mixture is subjected to sieving in the first step and to wind sifting in the second step, provides a sorting assembly comprising a first step with a screening set of $m \geqq 3$ successive sieves for classifying the feed mixture into successive screening classes, with which set the mesh sizes $x_i$ of the sieves are so selected that the settling rate fractions of each component to be sorted out are separate from or only slightly overlap the settling rate fractions of the other components, and a second step with at least two sets of wind sifters, a screening class each being feedable to the respective first wind sifters of said sets and the heavy fraction of the respective preceding wind sifter being feedable to the respective succeeding wind sifter as feed material, from which sets light fractions and heavy fractions, from the respective last wind sifters, of the components to be sorted out are adapted to be withdrawn individually or combined as desired, as pure or enriched component, by virtue of the graduation of the sifting air velocities in accordance with the coarsest and finest particles to be recovered of the respective components to be sorted out.

It is easy to adapt the cut-off limits of the second step according to need as the sifting air velocities are adjustable.

If the feed mixture is to be sorted into all its components, this can be accomplished with a sorting assembly comprising a first step with a set of sieves, including at least $m \geqq 3$ sieves for classifying the feed mixture into $(m+1)$ successive screening classes, with which set the mesh sizes $x_i$ of successive sieves are so selected that the settling rate classes of the individual components in each screening class are separate from each other or overlap only slightly, and a second step with $(m+1)$, at least $(m/2)+1)$, sets of (p-1) successive wind sifters each for each screening class to sort the same into fractions of one component each, one screening class each from the set of sieves being feedable to the respective first wind sifters of said sets and the heavy fraction of the respective preceding wind sifter being feedable to the respective succeeding wind sifter as feed material, and the light fractions of the same component each and the heavy fraction of the respective last wind sifters being adapted to be withdrawn individually or combined as desired, as pure or enriched component (FIGS. 3 and 4).

The mesh sizes $x_i$ are graded in accordance with equation (2) or a diagram as shown in FIG. 1.

Another preferred embodiment of the sorting assembly—for wind sifting of the feed mixture in the first and sieving in the second step—comprises a first step with $m \geqq 3$ successive wind sifters for classifying the feed mixture into successive settling rate classes of which the heavier settling rate class each of the first $(m-1)$ wind sifters is adapted to be fed to the respective next wind sifter as feed material, the sifting air velocities in the successive wind sifters being so adjustable that the screening fractions of the components to be sorted out in each settling rate class are separated from each other or overlap only slightly, and a second step with at least two sets of successive sieves, a settling rate class each from the wind sifters being feedable, upon separation from the sifting air, to the respective first sieves of said sets, and successive fractions of the pure or enriched component being separable by means of said sets by virtue of the graduation of the mesh sizes of the sieves in accordance with the grain size of the coarsest and finest particles which are to be recovered of the respective component to be sorted out, and said fractions of the same component each being adapted to be withdrawn from said sets individually or combined as desired.

This variant permits exact observation of the required class limits in the first step.

Again, if the feed mixture is to be sorted into all its components p, this is best accomplished in a sorting assembly comprising a first step with $m \geqq 3$ successive wind sifters by means of which the feed mixture is adapted to be classified into $(m+1)$ settling rate classes, of which the respective heavier settling rate class of the first $(m-1)$ wind sifters each is adapted to be fed to the respective succeeding wind sifter as feed material, and the sifting air velocities in the successive wind sifters are so adjustable that the screening fractions of the individual components in each settling rate class are separate from each other or overlap only slightly, and a second step with $(m+1)$, at least $((m/2)+1)$, sets of sieves each including $(p-1)$ successive sieves for each settling rate class for sorting the same into fractions of one component each, one settling rate class each from the wind sifters being adapted to be fed to the respective first sieves of said sets, each settling rate class being adapted to be sorted by said sets into fractions of the respective pure or enriched component by virtue of the graduation of the mesh sizes of the sieves, and the fractions of the same component each being adapted to be withdrawn individually or combined as desired (FIGS. 5 and 6).

The sifting air velocities are graded most conveniently in accordance with equation (3) or a diagram as shown in FIG. 1 in which the particle distributions of the components are entered and the line of steps is positioned between those two component curves indicating the smallest density ratio between any two components.

The invention may be realized in sorting assemblies whose structure is shown diagrammatically in the accompanying drawings, in which:

FIG. 3 is a diagram of an assembly for sorting a feed mixture consisting of two (p=2) components by means of sieves and (m+1) wind sifters into its two components, FIG. 4 is a diagram of an assembly for sorting a feed mixture consisting of p components by means of m sieves and (m+1)·(p−1) wind sifters into its p components, FIG. 5 is a diagram of an assembly for sorting a feed mixture consisting of two (p=2) components by means of m wind sifters and (m+1) single sieves into its two components, and FIG. 6 is a diagram of an assembly for sorting a feed mixture consisting of p components by means of m wind sifters and (m+1)·(p−1) sieves into its p components.

A two- or multi-component starting material is prepared for sorting in accordance with the method of the invention by simple sieving, sifting, or comminution. This conditioning of the basic materials is adapted in its sequence to the material in question and may be supplemented by special treatment or even left out if the starting material is available in disintegrated state, or an initial enrichment by screening or air classifying is not obtainable, or no impurities need be eliminated. The feed mixture is the result of this preparation.

In the case of the sorting assembly indicated in FIG. 3 a two-component feed mixture F is classified, in a first step, by means of a screening machine comprising a set 1 of m sieves 2 which are graduated in accordance with equation (2) to provide (m+1) successive adjoining screening classes. Screening machines suitable for this purpose are known in general. All the sieves 2 of the set 1 need not be located in a single screening machine. They may also be distributed to a plurality of successive screening machines, each including only one or two sieves. The mesh sizes or mesh apertures of the sieves are designated $x_1$ (coarsest mesh size) . . . $x_i$ . . . $x_{m-1}$ and $x_m$ (smallest mesh size). The coarsest screening class remains on the top sieve of the set of sieves having mesh size $x_1$, while the finest screening class is the one which drops even through the last sieve of the set of sieves having mesh size $x_m$, the smallest mesh size.

In the second step, each of these (m+1) screening classes is supplied through conduits 5 to one wind sifter 4 each of a total of (m+1) wind sifters connected in parallel at the output side and each constituting a single sifting stage 3.

The wind sifters 4 are shown diagrammatically as gravity air classifiers having a vertical sifting tube each into which sifting air L is introduced from below by means of a fan (not shown). The screening classes to be sifted which are supplied through a conduit 5 each enter laterally into the sifting air flowing in the air classifiers from bottom to top at a sifting air velocity $v_{Lc}$. The lighter particles whose settling rate $w_g$ is less than the limit or decisive sifting air velocity $v_{Lc}$ are entrained upwardly by the sifting air against their own gravity and are discharged together with the sifting air as the light fraction through an outlet 6. The heavy particles fall down against the rising sifting air flow and are discharged through an outlet 7 as the heavy fraction.

In the wind sifters 4 the limit sifting air velocities $v_{Lc}$ ($v_{L1}$ to $v_{L(m+1)}$) are adjusted at different values as determined with the aid of the above equation (4). Starting from the preceding screening of the feed mixture into narrow screening classes it is thus possible to achieve an almost complete separation of each class into the two components in the wind sifters 4. The light fraction issuing out of each outlet 6 of the wind sifters 4 is withdrawn by the sifting air into a manifold 11 and the heavy fraction issuing out of each outlet 7 of the wind sifters 4 is withdrawn into another manifold 12. At the output ends of the manifolds the pure or enriched light component is available as product P1 and the pure or enriched heavy component is available as product P2, respectively. These products may be directly subjected to further use together with the sifting air, or they may be separated first by separators (not shown), e.g. cyclone separators or air filters so as to be available as bulk material. Instead of being conveyed into a manifold, each light fraction and each heavy fraction of the wind sifters 4 may also be withdrawn individually or combined as desired, for instance, from the first, third and fifth wind sifters and from the second and fourth wind sifters, in the form of finished products, if desired, after previous separation from the sifting air.

Upon classifying in the screening machine, one or several or all of the screening classes may be subjected to selective comminution Z of the light component, prior to the wind sifting. To this end the respective class is first fed into a crushing unit and then into the corresponding wind sifter. The selective comminution is carried out with the aim of lowering the required sifting air velocity in the subsequent wind sifting.

In FIG. 3 the choice of the comminution Z is shown for the coarsest screening class drawn out by the first sieve 2 of the set 1 having the greatest mesh size $x_1$. This class is passed through a line 5′, if desired with the aid of a conveying means (not shown), into a diagrammatically illustrated crushing unit 9 and then through a line 5″ into the first wind sifter 4.

For sorting feed mixtures F with p components the sorting assembly according to FIG. 3 is to be enlarged in the manner indicated in FIG. 4. Here a set 10 each of (p−1) successive wind sifters 4 is provided for sorting by way of wind sifting of each of the (m+1) screening classes recovered from the set of sieves into p fractions of one component each. Thus there is a total of (m+1) sets 10 of wind sifters. The first wind sifters of all the sets of wind sifters, corresponding to the wind sifters of the sorting assembly according to FIG. 3, constitute a first sifting stage 3.1. And the respective next wind sifters of a set 10 of wind sifters constitute a corresponding further sifting stage each 3.j to 3.(p−1). The first wind sifter of each set 10 is charged with a screening class from the set 1 of sieves 2 through a conduit 5, thus receiving its feed. The heavy fraction formed in each wind sifter is withdrawn from outlet 7 and supplied as feed through a line to the next wind sifter in the set of the next sifting stage 3.j.

Equation (4) is drawn upon to determine the sifting air velocities $v_{Lj,c}$ required for the sets lo of wind sifters (index c ($1 \leqq c \leqq (m+1)$) and sifting stages (index j ($1 \leqq j \leqq (p-1)$). They increase from step to step. In the first sifting state 3.1 each light fraction withdrawn together with the sifting air from a wind sifter 4 through its outlet 6 and into a manifold 11 contains the lightest of the p components, as a first pure or enriched component, furnishing product P1. The light fractions of each successive sifting stage 3.j to 3.((p−1) provide the next heavier pure or enriched component. These are combined in a manifold 13 to furnish the product P3. The further heavier fractions are recovered in the further downstream sifting stages and, in the end, the heaviest of all components is obtained in the (p−1)th sifting stage 3.(p−1). They are combined by way of manifolds 14 and 15, respectively, to yield products P4 and P5, respectively.

The light fractions of each sifting stage and the heavy fraction of the last sifting stage may also be used as products, either individually or in any desired combination. Individual separations of the fractions of the components from the sifting air may be effected in separators (not shown) subsequent to the respective wind sifting. A joint separation may be provided after the combining in the manifolds.

A number of m sets 10 of wind sifters is sufficient if the finest material from the screening, having passed the last sieve of mesh size $x_m$ is not to be sorted and, therefore, may be withdrawn unsorted through a conduit 8 indicated by a broken line. Further reduction to (m−1) sets 10 of wind sifters or to (m−1) wind sifters 4 in the individual sifting stages 3 is possible if the material rejected by or passing through the coarsest sieve of the set 1 having mesh size $x_1$ is to be subjected to comminution and then returned into the feed mixture or removed for different treatment. A reduction to at least ((m/2)+1) wind sifters can be made if half of the screening classes is not subjected to sorting by wind sifting, for example, because they do not contain sufficient amounts of a component to be sorted out. Each set 10 of wind sifters will comprise more than (p−1) wind sifters if the components to be sorted out from among a plurality of components of the feed mixture are not adjacent ones in the graduation of the density and/or shape or in the graduation of the settling rate of all particles of the same size, in other words if a component between them is to be sorted out and utilized.

A set of wind sifters may comprise less than (p−1) wind sifters if the component or components to be sorted out of the screening class to be sifted is or are not contained therein in sufficient quantity. This may be the case, above all, with the coarsest and finest screening classes because the particle distributions of all components do not overlap entirely, see FIG. 1. The same applies to the alternative sorting to be described below.

Following the alternative product preparation described to furnish a suitable feed mixture, the sorting method may also be carried out by first wind sifting and then sieving. Sorting assemblies destined to carry into effect this alternative method may be gathered from FIGS. 5 and 6. With the sorting assembly according to FIG. 5 a two-component feed mixture F first is classified, in a first step, comprising a set of m successive wind sifters 21 which provide (m+1) successive settling rate classes. In each succeeding wind sifter 21 the limit or decisive sifting air velocity $v_{Li+1}$ is higher than in the respective preceding one. This graduation of speeds is determined in accordance with equation (3).

Separation into the two components is obtained in a second step. Each lighter settling rate class withdrawn from a wind sifter 21 through an outlet 26 and the heavy settling rate class withdrawn through an outlet 27 from the last wind sifter in which the sifting air velocity is $v_{Lm}$ is individually subjected to single sievings on a total of (m+1) sieves 24 connected in parallel at the outlet end and having mesh sizes $x_c$ ($1 \leqq c \leqq (m+1)$). The settling rate classes may be supplied to said sieves through conduits 25 upon separation from the sifting air in separators (not shown). The different mesh sizes $x_c$ of sieves 24 are so selected that the smallest particles of the heavy component in each settling rate class can just barely be separated completely, or with a slight lack of discrimination at most, from the greatest particles of the light component. The pure or strongly enriched light component is always found in the material rejected by the respective sieve and is discharged as light fraction into manifolds 31, all of which furnish the combined product P1. The pure or strongly enriched heavy component, on the other hand, passes the respective sieve and is discharged as heavy fraction into manifolds 32, all of which furnish the combined product P2.

When sorting multicomponent feed mixtures with p components of different density and/or shape into said p components, the second step in which sorting is effected by sieving, must be enlarged, as was the case with the assembly according to FIG. 4, so as to obtain an assembly as diagrammatically indicated in FIG. 6. Here the (m+1) settling rate classes yielded by the m wind sifters 21 of the first step are sorted by means of (m+1) screening machines 22 each comprising a set 23 of sieves. Each set is composed of (p−1) successive sieves 24 having mesh sizes $x_{c,j}$ (index c designating the set of sieves and index j designating the component, or sieving stage, or the sieve of the set of sieves). Each settling rate class passes through one of the sets 23 of (p−1) sieves 24 the mesh sizes of which are graduated in accordance with the adjoining grain size distributions of the components contained in the settling rate classes. The lightest component becomes enriched in the material rejected by the first and, therefore, coarsest sieve 24 of each set 23 (mesh size $x_{c,i}$). On the succeeding sieves of the sets of sieves (mesh size $x_{c,j}$), the heavier components become enriched as the mesh size diminishes. In the end, the heaviest component is obtained as the finest sorted fraction which passed through the (p−1)th sieve of each set of sieves (mesh size $x_{c,(p-1)}$). The total number of sieves provided is (m+1)·(p−1). The screening fractions of the same component each obtained from the sets 23 of sieves are discharged into manifolds 31, 33, 34, and 35, respectively and may be withdrawn together as products P1, P3, P4, and P5.

What we claim is:

1. A method of dry sorting a mixture of p granular polydisperse solid components to be sorted, where p is at least two, the particles of which component differ in density and/or shape and have at least partially overlapping grain size and settling rate distributions, comprising:

a. first classifying, by means of m successive sievings, where m is at least three, the mixture into m+1 successive screening classes in which the mesh size $x_i$ of each sieving is selected so that the settling rate of the particles of each component to be sorted in each screening class differs from or only slightly overlaps the settling rates of the particles of other components in such class, the mesh size $x_i$ determined by the smaller mesh size $x_i+1$ of the next sieve according to the equation:

$$x_i \leqq x_{i+1} \sqrt[n]{(\rho_S/\rho_L)_{min}}$$

in which n is a parameter between 2 and 1, allowing for the inclination of the curve of the drag coefficient of the sifting air flow around the particles at the sifting air velocity, and has a value of 2 in the range of laminar flow and a value of 1 in the range of turbulent flow, and a value which decreases from 2 to 1 approximately proportionally to the logarithm of the Reynolds number in the transitional range of flow, and $(\rho_S/\rho_L)_{min}$ is the smallest ratio of the density $\rho_S$ of a heavier component and the density $\rho_L$ of a lighter component;

b. then separately sorting at least the integral value of ((m/2)+2) of the m+1 screening classes by means of p−1 wind siftings, each screening class to be sorted being sorted into p settling rate fractions of one component each, said wind siftings being carried out at individual sifting air velocities selected for each screening class such that the particles of the respective components to be sorted having the highest and lowest settling rates are substantially separated; and c. recovering the light fraction after each sifting and the light and heavy fractions of the last sifting.

2. A method of dry sorting a mixture of p granular, polydisperse solid components to be sorted, where p is at least two, the particles of which components differ in density and/or shape and have at least partially overlapping grain size and settling rate distributions, comprising:

a. first classifying the mixture through m successive wind siftings into m+1 successive settling rate classes with the respective heavier class of the first m+1 wind siftings supplied as feed material to the respective next wind sifting and siftings carried out at individual sifting air velocities $v_{Li}$ of increasing magnitude selected such that the sieve grain sizes of individual components to be sorted in each settling rate class differ from each other or overlap only slightly, the sifting air velocity $v_{Li+1}$ in each successive wind sifting determined from the sifting air velocity $v_{Li}$ of an adjacent sifting stage in accordance with the equation:

$$v_{Li+1} \leqq v_{Li} \sqrt{(\rho_S/\rho_L)_{min}}$$

in which n is a parameter between 1 and 2, allowing for the inclination of the curve of the drag coefficient of the sifting air flow around the particles at the sifting air velocity, and has a value of 1 in the range of laminar flow and a value of 2 in the range of turbulent flow, and a value which rises from 1 to 2 approximately proportionally to the logarithm of the Reynolds number in the transitional range of flow, and $(\rho_S/\rho_L)_{min}$ is the smallest ratio of the density $\rho_S$ of a heavier component and the density $\rho_L$ of a lighter component; and b. then separately sorting at least the integral value of ((m/2)+1) of the m+1 settling rate classes to be sorted, by means of p−1 sievings, of each class into p screening fractions of one component each with individual mesh sizes selected for each settling class such that the particles of the respective components to be recovered having the coarsest and finest grain sizes are substantially separated into fractions, and recovering the coarsest fraction after each sieving and the finest and coarsest fractions of the last sieving.

3. A method as claimed in one of claims 1 or 2, wherein prior to sorting by further classification classes of the sieving are first subjected to selective comminution which is directed to comminuting the lighter components.

4. A method as claimed in one of claims 1 or 2, wherein at least some of the wind siftings are gravity-countercurrent air siftings in a rising air flow.

5. A method as claimed in one of claims 1 or 2, wherein at least some of the wind siftings are carried out as cross-current air siftings.

6. A method as claimed in one of claims 1 or 2, wherein at least some of the wind siftings are carried out as deflection air siftings.

7. A method as claimed in one of claims 1 or 2, wherein at least some of the wind siftings are carried out as centrifugal air siftings.

8. A sorting assembly for dry sorting a mixture of p granular, polydisperse solid components to be sorted, where p is at least two, the particles of which components differ in density and/or shape and have at least partially overlapping grain size and settling rate distributions, comprising:

a. a screening set of m successive sieves, where m is at least three for classifying the mixture into m+1 successive screening classes, the mesh sizes $x_i$ of each sieve selected such that the settling rate of the particles of each component to be sorted differ from or only slightly overlap the settling rates of the particles of the other components in such class, with each mesh size $x_i$ graduated with respect to the smaller mesh size $x_{i+1}$ of the succeeding sieve according to the equation:

$$x_i \leqq x_{i+1} \sqrt[n]{(\rho_S/\rho_L)_{min}}$$

in which n is a parameter between 2 and 1, allowing for the inclination of the curve of the drag coefficient of the sifting air flow around the particles at the sifting air velocity, and has a value of 2 in the range of laminar flow and a value of 1 in the range of turbulent flow, and a value which decreases from 2 to 1 approximately proportionally to the logarithm of the Reynolds number in the transitional range of flow, and $(\rho_S/\rho_L)_{min}$ is the smallest ratio of the density $\rho_S$ of a heavier component and the density $\rho_L$ of a lighter component; and b. at least the integral value of ((m/2)+1) sets of p−1 wind sifters, each set including at least a first wind sifter coupled to receive a screening class from said sieves and means for withdrawing the light fraction from each wind sifter and the heavy fraction from each respective last wind sifter of said sets of wind sifters to be recovered out of the components being sorted, the sifting air velocities being individually set in each of said wind sifters in accordance with the coarsest and finest particles of the respective components to be recovered from each screening class.

9. A sorting assembly according to claim 8 wherein p−1 is greater than 1 and the heavy fraction of the first wind sifter in each set is coupled to be fed to a second wind sifter in each set and so forth.

10. A sorting assembly for dry sorting a mixture of p granular, polydisperse solid components to be sorted, where p is at least two, the particles of which components differ in density and/or shape and have at least partially overlapping grain size and settling rate distributions comprising:

a. a set of m successive wind sifters, where m is at least three, coupled to receive a feed mixture and classify it into m+1 successive settling rate classes, said successive wind sifters coupled to each other such that the heavier settling rate class of each of the first m−1 wind sifters is coupled to be fed to the respective next wind sifter as feed material, the feed mixture to be classified being fed to the first wind sifter, the sifting air velocities $v_{Li}$ of increasing magnitude in the successive wind sifters selected such that the sieve grain sizes of the components to be sorted in each settling rate class differ from or only slightly overlap the sieve grain sizes of the other components in such class the sifting air velocities $v_{Li+1}$ determined by the sifting air velocity $v_{Li}$ of the preceding or following sifting according to the equation:

$$v_{Li+1}\ v_{Li}\sqrt[n]{(\rho_S/\rho_L)_{min}}$$

in which n is a parameter between 1 and 2, allowing for the inclination of the curve of the drag coefficient of the sifting air flow around the particles at the sifting air velocity, and having value 1 in the range of laminar flow and value 2 in the range of turbulent flow, and a value which rises from 1 to 2 approximately proportionally to the logarithm of the Reynolds number in the transitional range of flow, and $(\rho_S/\rho_L)_{min}$ is the smallest ratio of the density $\rho_S$ of a heavier component and the density $\rho_L$ of a lighter component; and b. at least the integral value of (m/2)+1) sets of p−1 sieves, including at least a first sieve coupled to receive a settling rate class from said wind sifters, and means for withdrawing at least the coarsest and finest particles from the last sieve of each set.

11. A sorting assembly according to claim 10 where in p−1 is greater than 1 and wherein the fine fraction from the first sieve and each sieve is fed to a second sieve and so forth, the sieve is in each set having a graduated mesh size, the graduations of said mesh sizes being such as to separate at least the coarsest and finest particles which are to be sorted out.

12. A sorting assembly as claimed in one of claims 8 or 10, wherein Mogensen sizers are provided for sieving.

13. A sorting assembly as claimed in one of claims 8 or 10, wherein at least some of the wind sifters are designed as gravity-counter-current air sifters.

14. A sorting assembly as claimed in one of claims 8 or 10, wherein at least some of the wind sifters are designed as cross-current air sifters.

15. A sorting assembly as claimed in one of claims 8 or 10, wherein at least some of the wind sifters are designed as deflection air sifters.

* * * * *

UNITED STATES PATENT AND TRADEMARK OFFICE

CERTIFICATE OF CORRECTION

PATENT NO. : 4,321,134

DATED : March 23, 1982

INVENTOR(S) : Kurt Leschonski and Stephan Röthele

It is certified that error appears in the above-identified patent and that said Letters Patent are hereby corrected as shown below:

Column 3, line 40, after "wind" change "on" to --or--.

Column 5, line 12, before "having" insert --n--.

Column 6, line 45, after "classes" insert --which--.

Column 10, line 60 (first line of table) after "1.=" delete "mesh".

Column 11, line 61, after "least" insert --(--.

Column 13, line 22, change "materials" to --material--.

Column 17, line 8, change "((m/2)+2)" to --((m/2)+1)--.

UNITED STATES PATENT AND TRADEMARK OFFICE

CERTIFICATE OF CORRECTION

PATENT NO. : 4,321,134

DATED : March 23, 1982

INVENTOR(S) : Kurt Leschonski and Stephan Röthele

It is certified that error appears in the above-identified patent and that said Letters Patent are hereby corrected as shown below:

Column 17, line 41, (in equation) change " $\sqrt{(\rho S/\rho L)min}$" to -- $\sqrt[n]{(\rho S/\rho L)min}$--.

Signed and Sealed this

*Twelfth* Day of *October 1982*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,321,134

DATED : March 23, 1983

INVENTOR(S) : KURT LESCHONSKI and STEPHAN RÖTHELE

It is certified that error appears in the above-identified patent and that said Letters Patent are hereby corrected as shown below:

Change Item [30] to read

--[30] Foreign Application Priority Data

Sep. 28, 1978 [DE] Federal Republic of Germany

2842259--

Signed and Sealed this

*Eighth* Day of *November 1983*

[SEAL]

*Attest:*

GERALD J. MOSSINGHOFF

*Attesting Officer*

*Commissioner of Patents and Trademarks*